US005653641A

United States Patent [19]

Heddon

[11] Patent Number: 5,653,641

[45] Date of Patent: Aug. 5, 1997

[54] BOWLING BALL RETURN GATE APPARATUS AND METHOD

[76] Inventor: Will Heddon, 640 Alternate 27, P.O. Box 628, Lake Hamilton, Fla. 33851

[21] Appl. No.: 593,571

[22] Filed: Jan. 30, 1996

[51] Int. Cl.[6] ..... A63D 5/02

[52] U.S. Cl. ..... 473/106; 473/110

[58] Field of Search ..... 473/106, 110, 473/111, 112, 114

[56] References Cited

U.S. PATENT DOCUMENTS

| | | |
|---|---|---|
| 1,885,662 | 11/1932 | Whitehorn . |
| 1,987,000 | 1/1935 | Cahill . |
| 2,247,787 | 7/1941 | Schmidt . |
| 2,600,918 | 6/1952 | Pohl . |
| 2,669,944 | 1/1954 | Keesling . |
| 2,765,172 | 10/1956 | Zuercher et al. . |
| 3,068,004 | 12/1962 | Gruss . |
| 3,068,006 | 12/1962 | Holloway . |
| 3,098,653 | 7/1963 | Gruss et al. . |
| 3,190,650 | 6/1965 | Zuercher . |
| 3,198,581 | 8/1965 | Gamberini . |
| 3,260,527 | 7/1966 | Younce . |
| 3,297,322 | 1/1967 | Ernst et al. . |
| 3,588,176 | 6/1971 | Byrne et al. . |
| 3,599,980 | 8/1971 | Harmond et al. . |
| 3,711,038 | 1/1973 | Van Otteren . |
| 4,135,685 | 1/1979 | Girshovich et al. . |
| 4,178,662 | 12/1979 | Borodin . |
| 4,272,078 | 6/1981 | Vinette . |
| 4,984,939 | 1/1991 | Foreman et al. . |
| 5,039,095 | 8/1991 | Buckley . |
| 5,193,804 | 3/1993 | Smit . |
| 5,292,121 | 3/1994 | Heddon . |
| 5,374,220 | 12/1994 | Burtchett . |
| 5,449,327 | 9/1995 | Heddon et al. . |

*Primary Examiner*—William M. Pierce
*Attorney, Agent, or Firm*—Allen, Dyer, Doppelt, Milbrath & Gilchrist, P.A.

[57] ABSTRACT

A bowling ball return gate operates in response to a ball tripping a lever for releasing the gate from its closed position for permitting the ball to be delivered to a center ball return shared by adjacent alleys. The gate operates in combination with an oscillating paddle positioned between kickbacks of the adjacent alleys wherein the paddle is moved from opening to adjacent alley opening of each adjacent kickbacks for alternately receiving a ball through the openings from its respective pit area while clearing any pins within the openings. The paddle moves within a T-tube section which is transverse to a longitudinal tube section housing the gate. The paddle is continuously moved between openings of the adjacent alley kickbacks for clearing pins on a continuous basis. The tripping lever holding the gate in its closed position can only be tripped by a ball entering the T-tube longitudinal section.

23 Claims, 4 Drawing Sheets

BOWLING BALL RETURN GATE APPARATUS AND METHOD

BACKGROUND OF INVENTION

1. Field of Invention

The invention relates generally to the game of bowling, and more particularly to handling bowling pins and balls in the bowling alley pit area for speedy delivery of balls back to a player at an approach end of the alley.

2. Background Art

In the game of bowling, it is desirable to return a ball to a bowler as efficiently and quickly as possible. Typically, bowling ball return mechanisms are shared between adjacent alleys or lanes. Balls and pins falling into each alley pit is typically such that the removal of the ball out of the pit area is delayed. Further, the problem of keeping pins out of the ball return area and causing jams persists even in state of the art ball and pit handling equipment. As a result, the return of the ball to the player is delayed, and operation of the alley may have to stop until the jam is manually removed.

U.S. Pat. No. 2,600,918 discloses a bowling ball return mechanism which includes a pair of pivotally mounted check gates positioned at adjacent kickbacks of adjoining alleys wherein the gates cooperate with each other for permitting a ball from one alley to force open its gate while preventing the adjoining gate from opening. A bowling ball being ejected from one pit area under the propulsion of a driving belt develops a momentum and thus a force for opening its gate. If its momentum is greater than that of a ball ejected from the adjacent alley, it will push the gate open to a maximum position permitting the it to be directed into a common ball return. The gates are positioned near the ends of two transverse ball return guides of adjoining alleys. The purpose of the gates is to allow one ball at a time to be ejected from its respective pit area and thus prevent the balls from both of the adjacent pit areas from colliding and jamming at the juncture of rear guide rails and the common center return.

U.S. Pat. No. 2,699,944 discloses a ball return mechanism for use between adjacent bowling alleys also comprising dual gates, one for each alley. A bowling ball delivered to its gate, forces the gate open under the force of its weight against the gate and is delivered into a ball return mechanism. Each gate is pivotal from an arm. The respective arms are connected by springs so that the gates are urges constantly too their closed positions. The gates deflect pins driven from the alley pin deck. When a gate is moved to an open position by a ball, movement of the adjacent gate is blocked until the ball which is holding the gate open is moved into a ball driving mechanism for return to the bowler.

U.S. Pat. No. 3,297,322 discloses an oscillating paddle positioned between the kickbacks of adjacent alleys for serving both alleys. The kickbacks have openings through which a ball may roll from the pit to a ball lift and return mechanism. The paddle is moved back and forth between the openings in each kickback so that pins entering the opening will not interfere with the ball lift mechanism. If a pin moves into the opening in the kickback when there is no ball ahead of it, the oscillating paddle will push the pin back into the pit so that a pin conveying mechanism within the pit area can deliver the pin to an elevating mechanism for delivery of the pin for pin setting.

SUMMARY OF INVENTION

The present invention, a bowling ball return apparatus comprises a housing having openings at an entrance end for receiving a bowling ball and at an exit end for delivering the ball to an alley ball return, the housing having a passage therebetween. The housing further has an opening within a housing wall portion for receiving a gate member rotatable from within the housing to a position out of the housing. The apparatus includes a gate member pivotal within the passage for movement from a first position, wherein the gate member gravitates under its weight, to a second position wherein the gate member is rotated by a bowling ball rolling through the passage from the entrance end to the exit end. The apparatus further includes a stop member pivotal for movement from a first position, wherein one end of the stop member extends into the housing through the opening, to a second position wherein the stop member is rotated by the bowling ball rolling through the passage. The stop member further has an opposing end proximate the gate member for preventing rotation of the gate member toward the exit end while the stop member is in its first position. Rotation of the gate member is permitted when the bowling ball rolls against the stop member one end causing the stop member to rotate into its second position, thus permitting the gate rotation by the ball rolling through the passage.

In use with a common tubular ball return shared by adjacent alleys, the apparatus comprises a tubular housing having transverse and longitudinal tube sections. The housing has first and second entrance openings at ends of the transverse tube section for receiving a bowling ball from either pit area of the adjacent bowling alleys between which the transverse tube extends. The entrance openings communicate with openings within kickbacks of the adjacent alleys for receiving bowling balls exiting from the pit areas. The transverse tube section further has a side wall opening communicating with an entrance end of the longitudinal tube section. The longitudinal tube section has an opening at an exit end for delivering the ball to a ball return tube extending longitudinally between the adjacent alleys. The longitudinal tube section is inclined downwardly from its entrance end to its exit end for causing the bowling ball positioned at the entrance end to gravitate toward the exit end. The housing further has an opening in a top wall portion of the transverse tube section for having a gate member rotatable within the longitudinal tube section pass therethrough thus permitting the bowling ball to gravitate from the entrance ends to the exit end of the housing. The gate member is pivotally mounted within the longitudinal tube section for movement from a first position proximate the longitudinal tube entrance end, gravity rotatably holding the gate member in the first position, to a second position wherein the gate member is rotated by a bowling ball rolling through the longitudinal tube section from the entrance end to the exit end. The stop member is pivotal for movement from a first position, wherein one end of the stop member extends into the longitudinal tube section forward of the gate member through the top wall portion opening, to a second position wherein the stop member is rotated by the bowling ball rolling through the passage. The stop member further has an opposing end proximate the gate member for preventing rotation of the gate member toward the exit end while the stop member is in its first position for preventing a bowling pin from entering the longitudinal tube section and ultimately the return tube. The stop member permits rotation of the gate member when the bowling ball rolls against the stop member end extending within the longitudinal tube causing the stop member to rotate into its second position, thus permitting gate rotation toward the exit end by the ball rolling through the longitudinal tube section toward the return tube.

The apparatus further includes means moveable within the transverse tube section between adjacent alley kickbacks for engaging and moving any pins exiting the pit area through the kickback openings and sweeping the pins back through their respective kickback opening into the pit area for delivery to a pin lift assembly. The pin engaging means oscillates between entrance ends of the transverse tube section within a period sufficient for permitting a bowling ball to gravitate toward the longitudinal tube section entrance end and cause rotation of the gate member for further rolling through the longitudinal tube section into the return tube.

It is a primary object of the present invention to expedite the delivery of a bowling ball from a pit area to a person at an approach area. It is further an object to expedite the return of a bowling ball through a common ball return between adjacent alleys while preventing pins from jamming within the ball return and disrupting bowling alley operation. It is further an object of the invention to provide a mechanically simple and inexpensive ball and pin gate mechanism when compared to those ball and pin gate mechanisms known and used in the art. It is further an object to reduce interconnections and interdependence between elements of typical pin and ball handling structures for reducing the alley capital and operating costs.

BRIEF DESCRIPTION OF DRAWINGS

A preferred embodiment of the invention as well as alternate embodiments are described by way of example with reference to the accompanying drawings in which.

DETAILED DESCRIPTION OF PREFERRED EMBODIMENT

Figure 1:
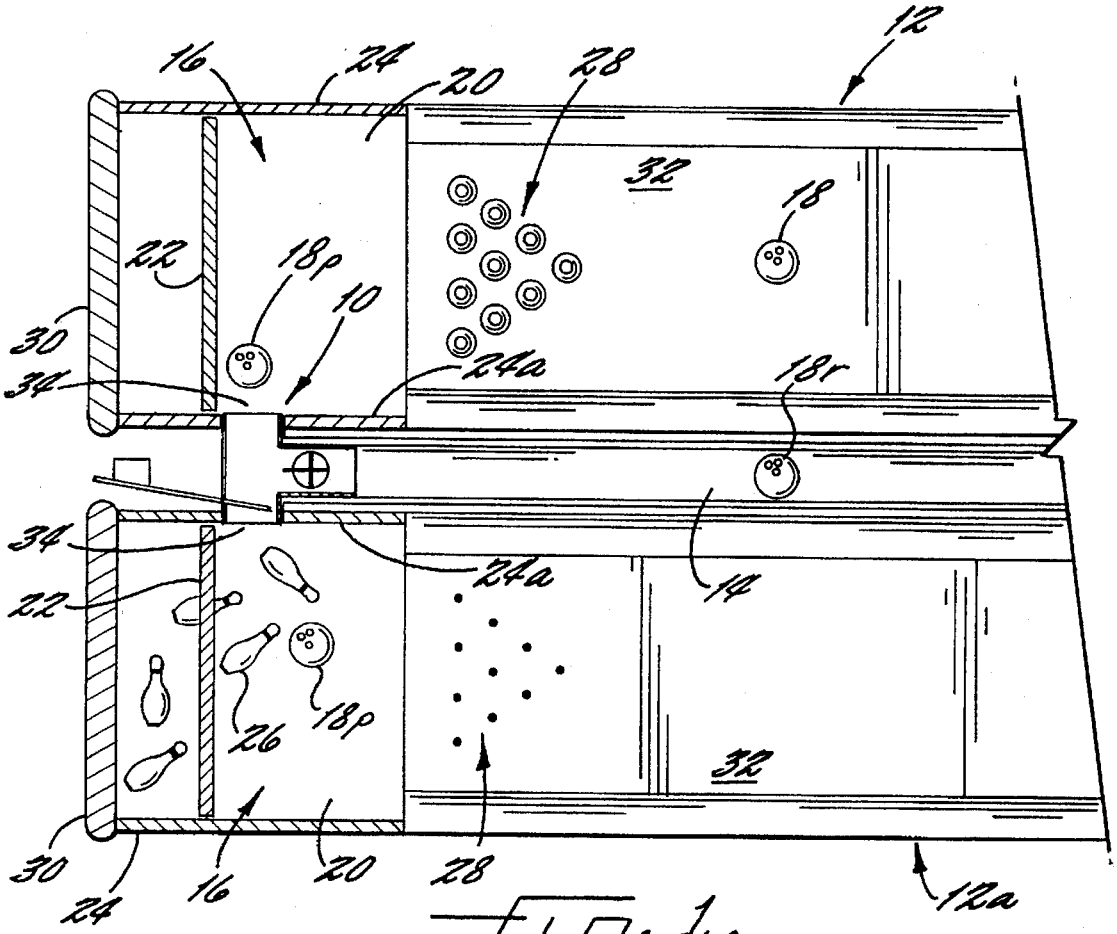
FIG. 1 is a plan view of pit ends of conventional side-by-side bowling alleys provided with a preferred embodiment of the present invention.

The preferred embodiment of the present invention, as illustrated with reference to FIG. 1, a ball and pin gate apparatus 10, is designed for use in a bowling alley 12 having a vacuum tube return 14 extending generally from a pit area 16 to an approach area shown) where a bowler receives and rolls a bowling ball 18. Although the apparatus 10 is useful in alternative mechanisms, the description herein presented is related to the bowling alley 12 having a conveyor belt 20 extending beneath a backstop 22 typically mounted transversely across the pit area 16 on an alley frame (not shown) between the alley kickbacks 24. The conveyor belt 20 delivers pins 26 falling into the pit area 16 from the pin set area 28 of the alley 12 aft to a pin elevator 30 for delivery to a pin setting mechanism (not shown) for cycling the pins 26 to their set positions 28 on the alley surface 32. Typically, and as is well known to one of ordinary skill in the art, the conveyor belt 20 runs continuously on rollers whereby the upper lap of the belt forms the bowling ball and pin receiving surface moving aft within the pit area 16. The backstop 22 is raised above the belt 20 for blocking the ball 18 from passing but permitting the pins 26 to be delivered to the elevator 30. As is known in the art, the conveyor belt 20, or its upper lap, is inclined toward a side of the alley sharing the ball return 14 with an adjacent alley 12*a*. In this way, the spent balls 18*p* falling into the pit area 16 and onto the conveyor belt 20 are delivered aft by their momentum and the rotating belt 20, blocked by the backstop 22, and are gravitated toward alley adjacent kickbacks 24*a* where they are received by an opening 34 within each kickback 24*a* for delivery to the ball return 14 extending longitudinally between the adjacent alleys 12, 12*a*.

Figure 2A:
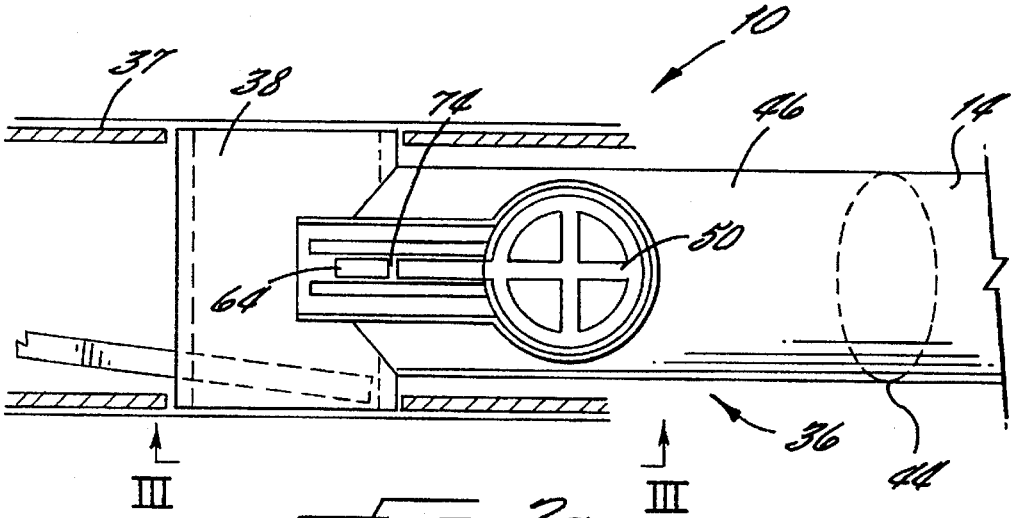
FIG. 2*a* is a plan view of a T-Tube housing for the embodiment of FIG. 1.
Figure 2B:
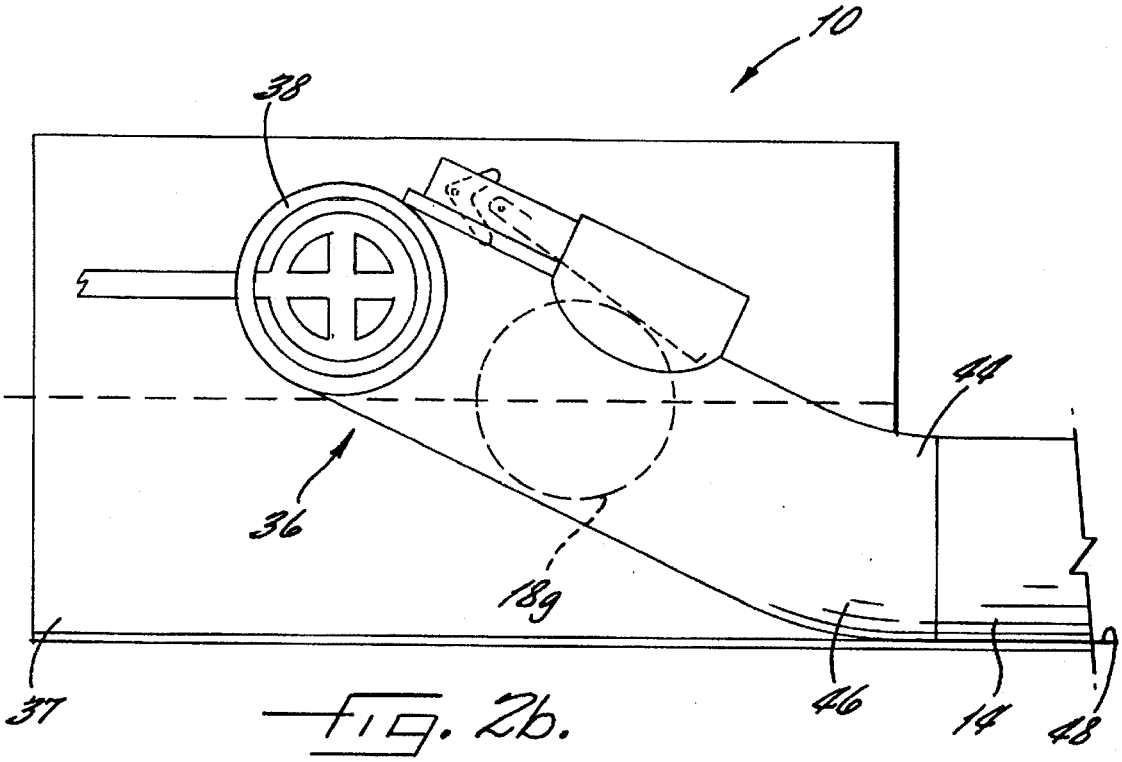
FIG. 2*b* is a side elevation view of the embodiment of FIG. 2*a;*

The present invention is directed to an apparatus 10 having a T-tube housing 36, as illustrated with reference to FIGS. 2*a* and 2*b*, wherein a transverse tube section 38 of the housing 36 has ball entrance ends 40, 42 communicating with the kickback openings 34 for receiving a ball 18*p* passing through the openings 34. Again with reference to FIG. 2*b*, the housing 36 has an exit end 44 at its longitudinal tube section 46 wherein the exit end 44 is connected to the ball return tube 14 for delivering the ball 18*p* into the tube 14, and thus delivery to the alley approach area. For the bowling alley 12, 12*a* herein described, the return tube 14 is generally laid horizontally along a ground surface 48 wherein a vacuum within the tube 14 sucks the ball 18*r* away from the pit area 16 toward the approach area where it is lifted for use by the player, as described by way of example in U.S. Pat. No. 5,449,327. As illustrated again with reference to FIG. 2*b*, a housing support 37 holds the housing 36 in an inclined position, inclined downwardly from its entrance ends 40, 42 to its exit end 44 to such a degree that the ball 18*p* gravitates toward the return tube 14 where its momentum and suction take it to the approach area. The present invention reduces the need for elaborate mechanical devices typically found in the art of ball returns by taking advantage of the gravitational forces on the ball 18*p* for getting from an inclined pit area 16 to the ball return tube 14.

Figure 3A:
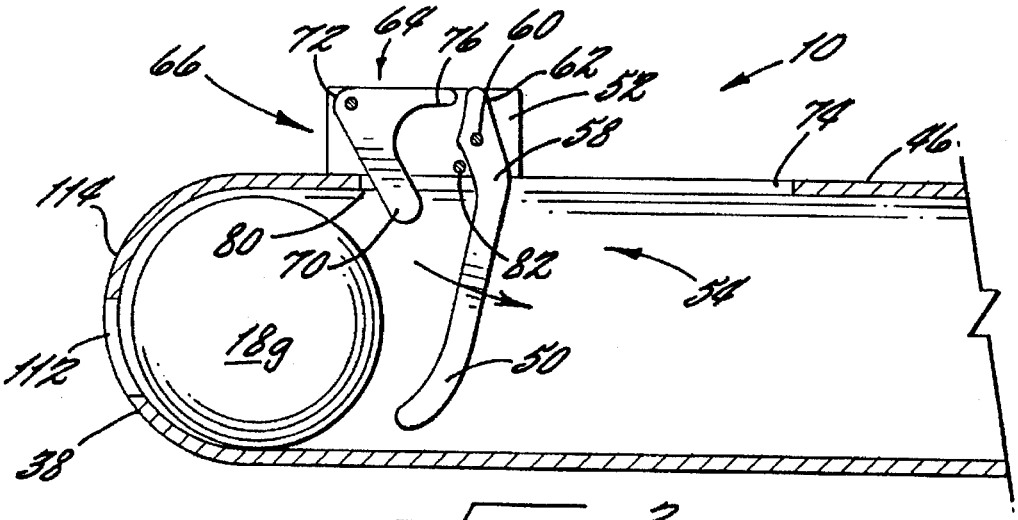
FIGS. 3*a*, 3*b*, and 3*c* are partial cross-sectional views illustrating operation of the preferred embodiment of the present invention.
Figure 3B:
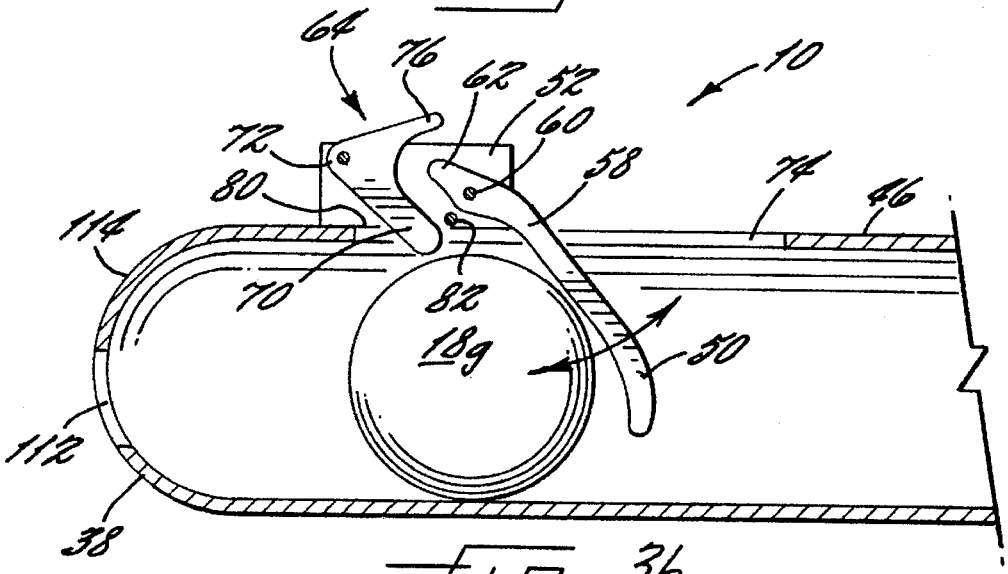
Figure 3C:
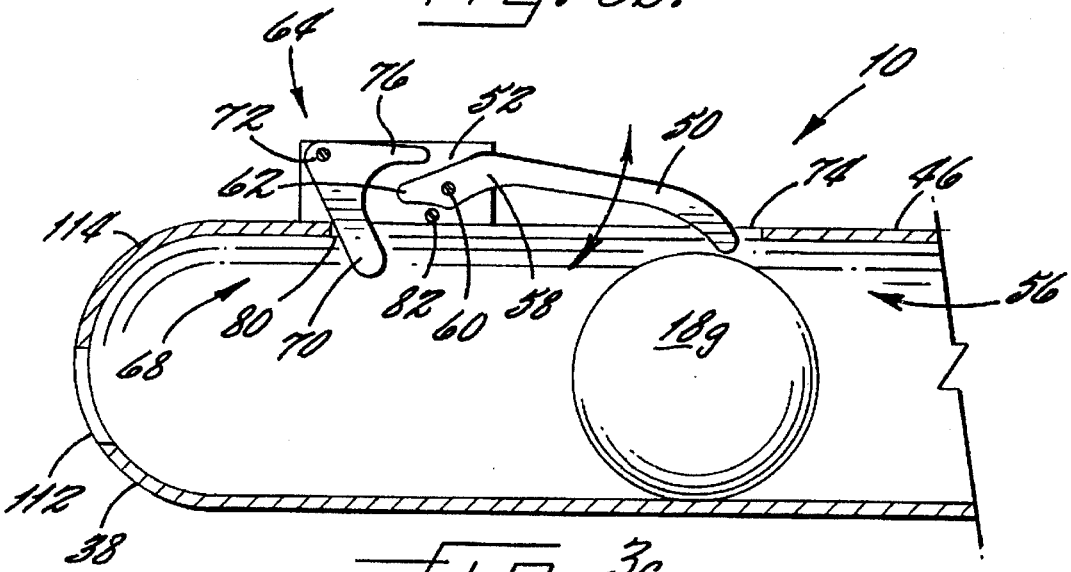

As illustrated with reference to FIGS. 3*a* through 3*c* (a partial cross-sectional view III—III), the apparatus 10 includes a gate member 50 which is pivotally attached to a block 52 affixed above the longitudinal tube section 46 for permitting a swinging movement (as illustrated by arrows) of the gate member 50 from a locked position 54 as illustrated with reference to FIG. 3*a*, to a fully open position 56 above the tube section 46 for permitting a ball 18*g* to pass through the tube section 46, as illustrated with reference to the sequence of FIG. 3*a* through FIG. 3*c*. The gate member 50 hangs under gravitational force in its locked position 54 under the weight of the gate member 50. The gate member 50 has an arm member 58 extending from the member 50 to the block 52 where it is pivotally connected to the block 52 by a pivot pin 60 at an arm member distal end 62.

A gate stop member 64 is pivotally attached to the block 52 for movement from its locking position 66 to its open position 68 as illustrated again with reference to FIGS. 3*a* and 3*c*, respectively. The gate stop member 64, in its locking position 66, has a ball release end 70 extending into the longitudinal tube section sufficiently for a ball 18*g* rolling within the longitudinal tube section 46 to contact the end 70 and cause it to pivot about its pivot pin 72 for raising the gate stop member ball release end 70 out of the tube section 46. As illustrated with reference to FIGS. 2*a*, 2*b*, and 3*a* through 3*b*, the housing 36 includes an opening 74 within its top most wall portion for permitting pivotal movement of the both the gate member 50 and the gate stop member 64 in and out of the longitudinal tube 46 and thus housing 36. Again with reference to FIGS. 3*a* through 3*c*, the gate stop member 64 has a stop end 76 opposing the ball release end 70 which communicates with the gate arm member distal end 62 for blocking the swinging movement of the gate member 50 toward the exit end 44 while the gate stop member is in its locking position 66. The gate stop member 64, pivotally attached to the block by its pivot pin 72, is held in the locking position under its weight and the moment force of the gate stop member 64 pivotal about the pivot pin 72 located within the stop member 64 for positioning against a portion of the housing wall 80 while in its locking position 66. As the ball 18*g* enters the longitudinal tube section 46 from the transverse tube section 38, as illustrated with reference to FIG. 3*a*, it contacts the gate stop ball release end 70 causing the gate stop member 64 to pivot about its pin 72 thus causing the stop end 76 to rotate away from the gate member arm distal end 62 thus permitting the gate member 50 to rotate through the forces of the ball 18*g* against the gate 50, as illustrated with reference to FIG. 3*b*, and continue rotating under the forces of the rolling ball 18*g* to its full open position 56 as again illustrated with reference to FIG. 3*c*. As the ball 18*g* continues to gravitate and roll toward the return tube 14 and out of contact with the gate member 50, the gate member 50 will swing back into its blocking position 54 as will the gate stop member 64 swing back to its locking position 66, both under the influence of gravity and their own weight as earlier described.

A fixed stop 82 is positioned on the block 52 for limiting rotation of the gate member 50 aft of its locked position 54 toward the housing transverse tube section 38 to prevent another ball from rolling under or into an end of the gate member 50 and causing a jam or damage to the gate member 50 when not in a position for receiving the ball 18*g* or blocking a pin 26. The stop 82 is positioned for further limiting the gate stop ball release end 70 from swinging into the gate member arm 58 and potentially causing yet another jam.

Figure 4:
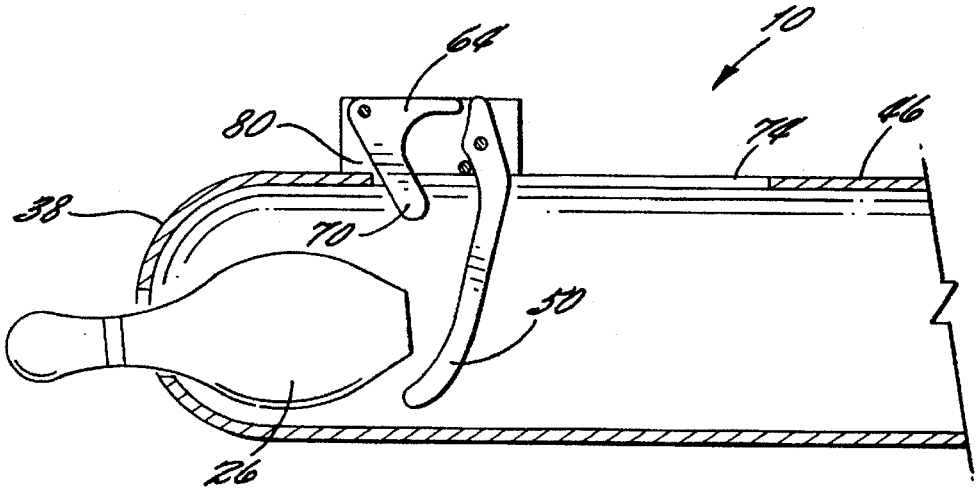
FIG. 4 is a partial cross-sectional view of the preferred embodiment illustrating a blocking of a bowling pin.

As illustrated with reference to FIG. 4, the ball gate member 50 extends sufficiently into the longitudinal tube section 46 for blocking a pin 26 and preventing the pin 26 from entering the tube section 46 and passing into the return tube 14. Further, the gate stop member ball release end 70 extends into the section 46 only enough to make contact with the ball 18*g*, as earlier described, yet avoid contact with the fallen pin 26. As earlier described, the gate stop member 64 rests against the housing tube section upper wall 80 along the periphery of the opening 74 as illustrated again with reference to FIG. 4.

Figure 5A:
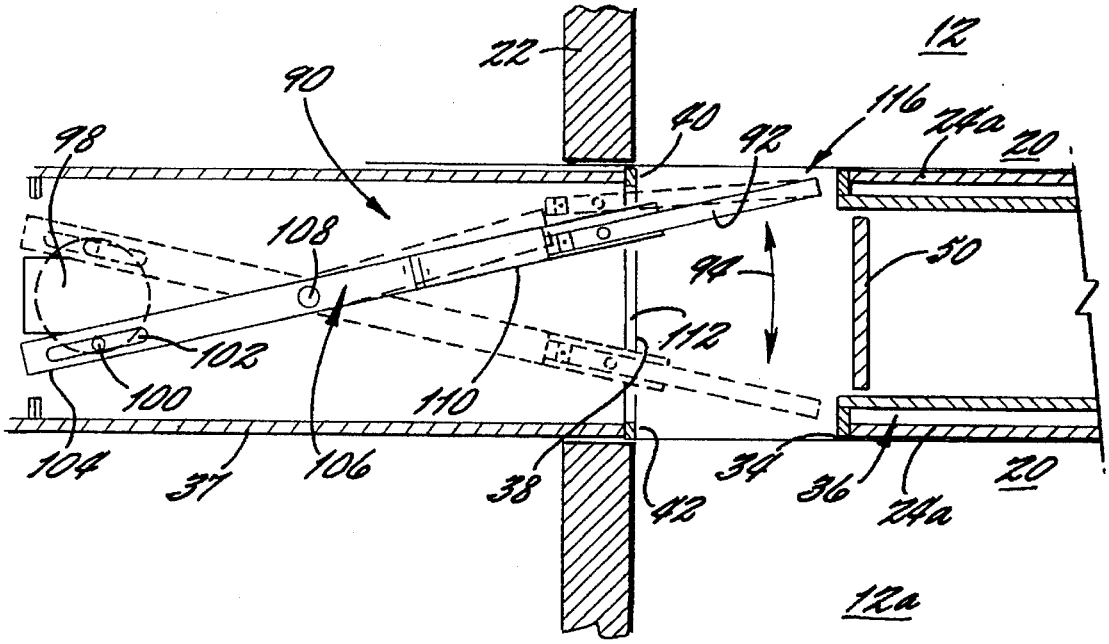
FIGS. 5*a* and 5*b* are top plan and side elevational views of a paddle assembly of the present invention.
Figure 5B:
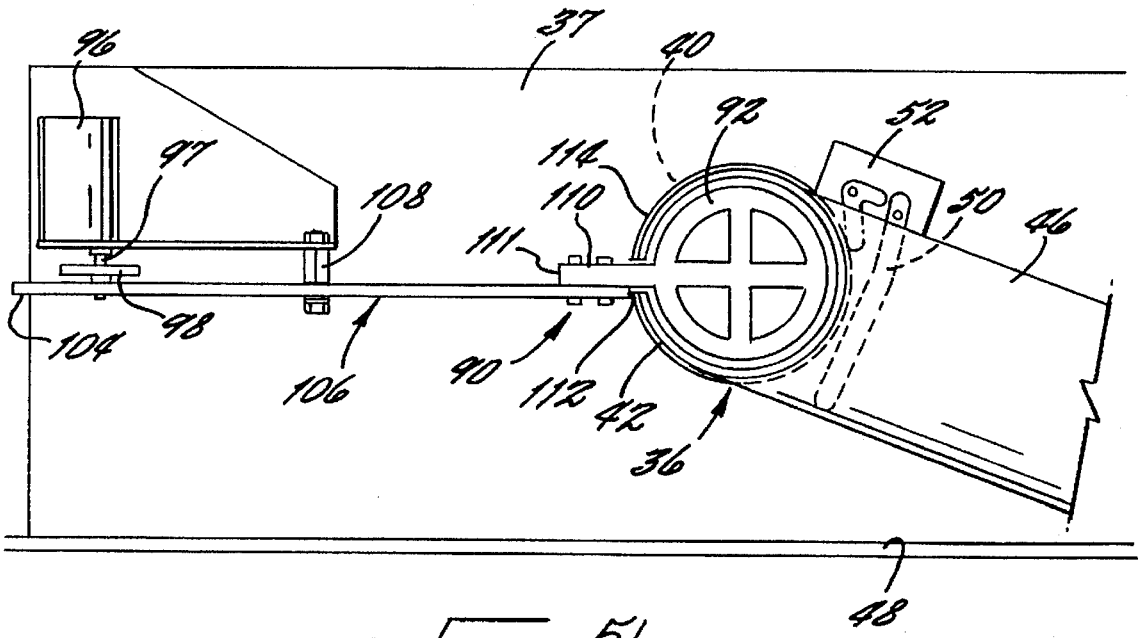

In the preferred embodiment of the present invention, and with reference to FIGS. 5*a* and 5*b*, a paddle assembly 90 includes a paddle member 92 sized to substantially block the ball 18*p* or the pins 26 from entering the housing entrance ends 40, 42 when positioned proximate the ends 40, 42 for that purpose. The paddle member 92 is moved from entrance end 40 to entrance end 42 (back and forth) within the transverse tube section 38 between the adjacent kickbacks 24*a* as indicated by the arrow 94 of FIG. 5*a*. With such a movement or oscillation from end 40 to end 42, pins 26 entering the tube section 38 as described earlier with reference to FIG. 4, will be pushed or swept out onto the conveyor belts 20 and carried to their proper destination, the elevator 30, as earlier described with reference to FIG. 1.

In the paddle assembly 90 used in the present invention, a motor 96 is continuously operated. The motor shaft 97 is attached to a disk 98 for rotation of the disk 98. A pin 100 affixed at a periphery of the disk 98 travels within a slot 102 within a proximal end 104 of a paddle assembly arm 106. Rotation of the disk 98 causes the paddle arm 106 to oscillate about its pivot pin 108 thus causing oscillating of the arm distal end 110 to which the paddle member 92 is attached. The arm 106 extends through a slot 112 within a side wall 114 of the transverse tube section 38 for movement of the arm distal end 110 within the slot 112 and thus the paddle member 92 from end 40 to end 42 within the transverse tube section 38, as earlier described.

In the preferred embodiment, the paddle distal end 110 is further pivotal, as indicated at numeral 111, proximate the paddle member 92 for absorbing the force of the ball 18*g* as it rolls against the paddle member 92 when within the tube section 38. Further, by pivoting the arm member 106 at 111, a more uniform blocking of the ends 40, 42 is realized as the paddle sweeps the pins 26 out onto the belt 20. Further, and again as illustrated with reference to FIG. 5*a*, when in a ball receiving position 116 for one alley 12*a* and pit ejecting position for the other alley 12, the paddle member 92 guides the ball 18*g* into the longitudinal tube section 46 for movement toward the return tube 14 as earlier described with reference to FIGS. 3*a* through 3*c*. The ball 18*g* is thus directed for rolling into the longitudinal tube section 46.

The apparatus 10 herein described was designed for use between adjoining alleys 12, 12*a* but can be used with a single alley 12 by blocking one entrance end 42 or by using an L-tube housing rather that the T-tube housing 36 herein described.

While a specific embodiment of the present invention has been described in detail herein above, it is to be understood that various modifications may be made from the specific details described herein without departing from the spirit and scope of the invention as set forth in the appended claims. Having now described the invention, the construction, the operation and use of preferred embodiments thereof, and the advantageous new and useful results obtained thereby, the new and useful constructions, methods of use and reasonable mechanical equivalents thereof obvious to those skilled in the art, are set forth in the appended claims.

What is claimed is:

1. A bowling ball return apparatus comprising:

a housing having openings at an entrance end for receiving a bowling ball and at an exit end, the housing further having a passage between the ends and an opening within a housing wall portion;

a gate member moveable within the passage for movement from a first position within the passage, wherein the gate member gravitates under its weight, to a second position above the passage, wherein the gate member is moved by a bowling ball rolling through the passage from the entrance end to the exit end; and a stop member adjacent the gate member and moveable from a first position, wherein one end of the stop member extends into the housing through the opening, to a second position wherein the stop member is rotated by the bowling ball rolling through the passage, the stop member further having an opposing end means proximate the gate member for preventing movement of the gate member toward the exit end while the stop member is in its first position and permitting movement of the gate member when the bowling ball rolls against the stop member one end moving the stop member into its second position, thus permitting the gate movement by the ball rolling through the passage.

2. The apparatus as recited in claim 1, further comprising means for supporting the housing wherein the passage extends generally coincident with a longitudinal axis of an alley ball return.

3. The apparatus as recited in claim 2, wherein the supposing means further positions the housing for inclining the passage from the entrance end downwardly toward the exit end thus causing the bowling ball to gravitate and roll through the passage from the entrance end to the exit end.

4. The apparatus as recited in claim 1, further comprising means for sweeping pins away from the entrance end.

5. The apparatus as recited in claim 1, further comprising:

a block attached to an upper wall portion of the housing;

a gate pivot pin means mounted on the block for rotational attachment of the gate member to the gate pivot pin; and a stop pivot pin means mounted on the block for rotational attachment of the stop member to the stop pivot pin.

6. The apparatus as recited in claim 5, further comprising a stop pin means mounted on the block for limiting rotation of the gate member toward the housing entrance end, the stop pin means further limiting rotation of the stop member toward the gate member for preventing contact of the stop member one with the gate member during rotation of the stop member to its second position.

7. The apparatus as recited in claim 1, wherein the housing comprises a T-tube having a longitudinal tube section and a transverse tube section, the longitudinal tube section having the exit end opening for communicating with a return tube extending between adjacent alleys, the transverse tube section having a side wall opening for delivering the bowling ball therethrough, the gate member positioned within the longitudinal tube section proximate the side wall opening, the transverse tube section further having first and second tube entrance end openings for receiving a bowling ball from either of the adjacent alleys.

8. The apparatus as recited in claim 7, further comprising means for sweeping pins passing into the transverse tube section away from the gate member and out of the transverse tube section exit end openings.

9. The apparatus as recited in claim 8, wherein the sweeping means comprises:

a paddle for substantially blocking the transverse tube openings, the paddle positioned for oscillating movement between the transverse tube entrance ends; and means for moving the paddle in an oscillating motion from one transverse entrance end to the other while sweeping past the side wall opening for causing the paddle to sweep pins from within the transverse tube section.

10. The apparatus as recited in claim 9, wherein the paddle moving means comprises:

an elongated paddle arm pivotally mounted at a central arm portion, the paddle arm having a distal end attached to the paddle and a proximal end for attachment to a motor assembly, the transverse tube section having a side wall slot for loosely receiving the arm, the proximal end having a slot for movement of a pin within the slot; and a motor assembly having a motor and wheel attached to a motor shaft for continuous rotation of the wheel, the wheel having a pin attached at a periphery of the wheel for engaging the slot for causing oscillating movement of the paddle arm proximal end and thus paddle during rotation of the wheel.

11. A bowling alley ball return apparatus comprising:

a tubular housing having transverse and longitudinal tube sections, the housing having first and second entrance openings at ends of the transverse tube section adapted for receiving a bowling ball from adjacent bowling alleys, the entrance openings adapted for communicating with openings within kickbacks of the adjacent alleys for receiving bowling balls therethrough, the transverse tube section further having a side wall opening for delivering a bowling ball therethrough, the longitudinal tube section having an entrance end adapted for communicating with the side wall opening, the longitudinal tube section further having an opening at an exit end for delivering the ball to a ball return bowling alley, the longitudinal tube section inclined downwardly from its entrance end to its exit end for causing the bowling ball positioned at the entrance end to gravitate toward the exit end, the housing further having an opening in a top wall portion;

a gate member moveable within the housing from a first position proximate the longitudinal tube entrance end, gravity rotatably holding the gate member in the first position, to a second position wherein the gate member is rotated by a bowling ball rolling through the longitudinal tube section from the entrance end to the exit end; and a stop member moveable from a first position, wherein one end of the stop member extends into the longitudinal tube section forward of the gate member, to a second position wherein the stop member is moveable by the bowling ball rolling through the passage, the stop member further having an opposing end proximate the gate member for preventing gate member movement toward the exit end while the stop member is in its first position for preventing a bowling pin from entering the longitudinal tube section, the stop member permitting gate member movement when the bowling ball rolls against the stop member end, the stop member thus moveable into its second position for permitting gate movement toward the exit end by the ball rolling through the longitudinal tube section toward the exit end.

12. The apparatus as recited in claim 11, further comprising means adapted for movement within the transverse tube section between adjacent alley kickbacks for engaging and moving any pins entering the housing out through the kickback openings, the pin engaging and moving means oscillating between entrance ends of the transverse tube section within a period sufficient for permitting a bowling ball to gravitate toward the longitudinal tube section entrance end and causing movement of the gate member for ball delivery through the longitudinal tube section into the return tube.

13. The apparatus as recited in claim 12, wherein the pin engaging and moving means comprises:

a substantially vertical paddle extending across one entrance opening for preventing a pin from passing through the one opening; and driving means for moving the paddle between the transverse tube entrance ends and thus the kickback openings, the movement for oscillating the paddle in a back and forth motion between entrance ends in a horizontal path of travel relative to the openings adapted to effect the removal of pins from the transverse tube section and outward through the entrance openings.

14. The apparatus as recited in claim 13, wherein the driving means comprises:

an elongated paddle arm pivotally mounted at a central arm portion, the paddle arm having a distal end attached to the paddle and a proximal end for attachment to a motor assembly, the transverse tube section having a side wall slot for loosely receiving the arm, the proximal end having a slot for movement of a pin within the slot; and a motor assembly having a motor and wheel attached to a motor shaft for continuous rotation of the wheel, the wheel having a pin attached at a periphery of the wheel for engaging the slot for causing oscillating movement of the paddle arm proximal end and thus paddle during rotation of the wheel.

15. The apparatus as recited in claim 11, further comprising:

a block attached to an upper wall portion of the longitudinal tube section;

a gate pivot pin mounted to the block for rotational attachment of the gate member to the gate pivot pin; and a stop pivot pin mounted to the block for rotational attachment of the stop member to the stop pivot pin.

16. The apparatus as recited in claim 15, further comprising a stop pin mounted on the block for limiting rotation of the gate member toward the longitudinal tube section entrance end, the stop pin further limiting rotation of the stop member toward the gate member for preventing contact of the stop member end extending into the longitudinal tube section form contacting the gate member during rotation of the stop member to its second position.

17. A method for returning a bowling ball from a pit area of a bowling alley to a ball return, the method comprising the steps of:

delivering a bowling ball from within a pit area of a bowling alley to an opening within a kickback;

providing a housing having an entrance end, an exit end, and a passage therebetween, the housing entrance end adapted for receiving a bowling ball from a kickback opening;

receiving the ball at an entrance opening;

providing a gate member at the entrance end of the housing for preventing bowling pins from from passing therethrough, the gate member moveable from a first position to a second position wherein the gate member is moved by a bowling ball rolling through the passage from the entrance end to the exit end;

providing a stop member for holding the gate member in the first position, the stop member positioned between the gate member and entrance end;

rolling the bowling ball through the passage and toward the housing exit end, the ball contacting the stop member; and moving the stop member with the rolling ball, the stop member moving from a first position wherein the gate member is held in the gate member first position to a second position permitting the ball to roll into the passage moving the gate member out of its first position to its second position and through the passage, thus rolling the ball into the ball return.

18. The method as recited in claim 17, further including the step of inclining the passage for rolling the ball by a gravitational force from the kickback and housing entrance openings through the passage and into the ball return.

19. The method as recited in claim 17, further comprising the steps of providing a paddle for movement across the housing entrance end and moving the paddle for sweeping pins passing through the kickback opening back through the kickback opening and onto a pit conveyor for delivering the pins to a lift assembly.

20. A method for returning a bowling ball from a bowling alley pit area to a common tubular ball return extending generally longitudinally between adjacent alleys sharing the ball return, the method comprising the steps of:

rolling a bowling ball from a pit area of an alley toward an opening in a kickback for exiting the ball from the pit area through the opening;

providing a tubular housing having transverse and longitudinal tube sections, the housing having first and second entrance openings at ends of the transverse tube section for receiving the bowling ball from the pit area of adjacent bowling alleys between which the transverse tube extends, the entrance openings adapted for communicating with openings within kickbacks of the adjacent alleys for receiving bowling balls exiting from the pit area, the transverse tube section further having a side wall opening adapted for communicating with an entrance end of the longitudinal tube section, the longitudinal tube section having an opening at an exit end for delivering the ball to a ball return tube extending longitudinally between the adjacent alleys, the longitudinal tube section inclined downwardly from its entrance end to its exit end for causing the bowling ball positioned at the entrance end to gravitate toward the exit end, the housing further having an opening in a top wall portion of the transverse tube section for receiving a gate member moveable within the longitudinal tube section for permitting the bowling ball to gravitate from the entrance ends to the exit end of the housing;

receiving the bowling ball at the entrance opening;

gravitating the ball toward the longitudinal tube section entrance end;

providing a gate member pivotally mounted within the longitudinal tube section for movement from a first position proximate the longitudinal tube entrance end, gravity rotatably holding the gate member in the first position, to a second position wherein the gate member is rotated by the bowling ball rolling through the longitudinal tube section from the entrance end to the exit end;

providing a stop member pivotally mounted for movement from a first position, wherein one end of the stop member extends into the longitudinal tube section forward of the gate member through the top wall portion opening, to a second position wherein the stop member is rotated by the bowling ball rolling through the passage, the stop member further having an opposing end proximate the gate member for preventing rotation of the gate member toward the exit end while the stop member is in its first position for preventing a bowling pin from entering the longitudinal tube section and ultimately the return tube;

rolling the ball against the stop member for permitting rotation of the gate member when the bowling ball rolls against the stop member end extending within the longitudinal tube causing the stop member to rotate into its second position, thus permitting gate rotation toward the exit end by the ball rolling through the longitudinal tube section toward the return tube; and rolling the ball against the gate member for rotating the gate member for rolling through the longitudinal tube section into the return tube.

21. The method as recited in claim 20, further comprising the step of sweeping pins from the transverse tube section to the pit area through the kickback openings, the pins of each adjacent alley being alternately moved from within the transverse tube section to their respective pit areas.

22. The method as recited in claim 21, wherein the pin sweeping step comprises the steps of:

providing a paddle substantially across an entrance opening for preventing a pin from passing through the opening; and moving the paddle between the transverse tube entrance ends and thus the kickback openings, the moving in a back and forth motion of the paddle between entrance ends for effecting the removal of pins from the transverse tube section and into the pit areas.

23. The method as recited in claim 22, wherein the step of moving the paddle comprises the steps of providing an elongated paddle arm pivotally mounted at a central arm portion, the paddle arm having a distal end attached to the paddle, providing a side wall slot in the transverse tube section for loosely receiving the arm, providing a slot in a paddle arm proximal end for movement of a pin within the slot, and moving the pin within the slot for causing oscillating movement of the paddle arm proximal end and thus paddle.

* * * * *